US006412251B1

(12) United States Patent
Early

(10) Patent No.: US 6,412,251 B1
(45) **Date of Patent: *Jul. 2, 2002**

(54) WEB CORE STRUCTURAL PANEL

(75) Inventor: Stephen R. Early, Olathe, KS (US)

(73) Assignee: Aero Transportation Products, Inc., Independence, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/652,257

(22) Filed: Aug. 30, 2000

Related U.S. Application Data

(63) Continuation-in-part of application No. 09/441,706, filed on Nov. 16, 1999.

(51) Int. Cl.[7] ..... E04C 2/54

(52) U.S. Cl. ..... 52/783.1; 52/784.14; 52/784.16; 52/793.1; 52/799.11; 52/49; 52/56; 52/82

(58) Field of Search ..... 52/49, 56, 82, 52/783.1, 784.14, 784.16, 793.1, 799.11

(56) References Cited

U.S. PATENT DOCUMENTS

| | | | |
|---|---|---|---|
| 1,136,792 | A | 4/1915 | Goldsmith |
| 1,148,002 | A | 7/1915 | Anderson |
| 1,484,579 | A | 2/1924 | Still |
| 2,012,889 | A | 8/1935 | McIntyre |
| 2,074,439 | A | 3/1937 | Tangerman |
| 2,697,990 | A | 12/1954 | Parsons et al. |
| 2,920,682 | A | 1/1960 | Lindberg |
| 2,995,806 | A | 8/1961 | Allison et al. |
| 3,538,668 | A | 11/1970 | Anderson |
| 3,914,062 | A | 10/1975 | Heininger |
| 3,914,861 | A | 10/1975 | Phillips |
| 3,943,521 | A | 3/1976 | Phillips |
| 4,310,132 | A | 1/1982 | Robinson et al. |
| 4,353,313 | A | 10/1982 | Panagin |
| 4,365,736 | A | 12/1982 | Stumm |
| 4,397,434 | A | 8/1983 | Farnham |
| 4,417,526 | A | 11/1983 | Marulic et al. |
| 4,492,215 | A | 1/1985 | DiGianvittorio |
| 4,550,480 | A | 11/1985 | Tanikawa et al. |
| 4,807,802 | A | 2/1989 | Williams |
| 4,867,327 | A | 9/1989 | Roland |
| 4,875,795 | A | 10/1989 | Anderson |
| 4,892,435 | A | 1/1990 | Anderson |
| 4,894,967 | A | 1/1990 | Morton |
| 4,945,488 | A | 7/1990 | Carver et al. |
| 4,973,506 | A | 11/1990 | Bauer et al. |
| 4,993,329 | A | 2/1991 | Takeich et al. |
| 4,993,619 | A | 2/1991 | Kresse, Jr. et al. |
| 5,086,997 | A | 2/1992 | Glass |
| 5,118,552 | A | 6/1992 | Sempolinski |
| 5,190,207 | A | 3/1993 | Peck et al. |
| 5,244,158 | A | 9/1993 | Popovich |
| 5,249,818 | A | 10/1993 | Patterson |
| 5,267,515 | A | 12/1993 | Tsuruda et al. |
| 5,383,406 | A | 1/1995 | Vanolo et al. |
| 5,651,910 | A | 7/1997 | Myers et al. |
| 5,768,851 | A | 6/1998 | Nagaoka |
| 5,803,402 | A | 9/1998 | Kurmweide et al. |
| 5,806,797 | A | 9/1998 | Micale |
| 5,878,940 | A | 3/1999 | Rosenbalm |

*Primary Examiner*—Carl D. Friedman
*Assistant Examiner*—Dennis L. Dorsey
(74) *Attorney, Agent, or Firm*—Chase Law Firm, L.C.

(57) ABSTRACT

A panel system includes a first skin, a second skin, a web core constructed from sheet material for securing the skins together in a spaced, sandwich relationship, and a connecting means for affixing the web core within the skins. The web core includes a plurality of spaced apart longitudinal members having longitudinally spaced projections extending therefrom and further having transversely aligned, longitudinally spaced slots therein. The web core further includes a plurality of spaced-apart, transverse cross members each having spaced slots therein receiving the longitudinal members at corresponding transversely aligned slots thereof to provide an interlocked grid between the first and second skins. The grid is connected to the skins utilizing the projections, which extend through slits in the skins to facilitate welding or otherwise bonding the components.

11 Claims, 11 Drawing Sheets

Fig. 14
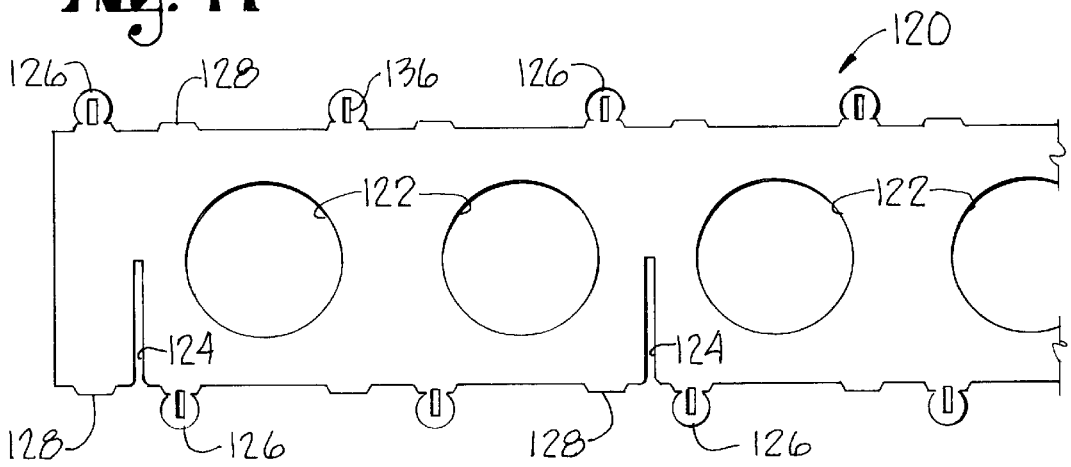
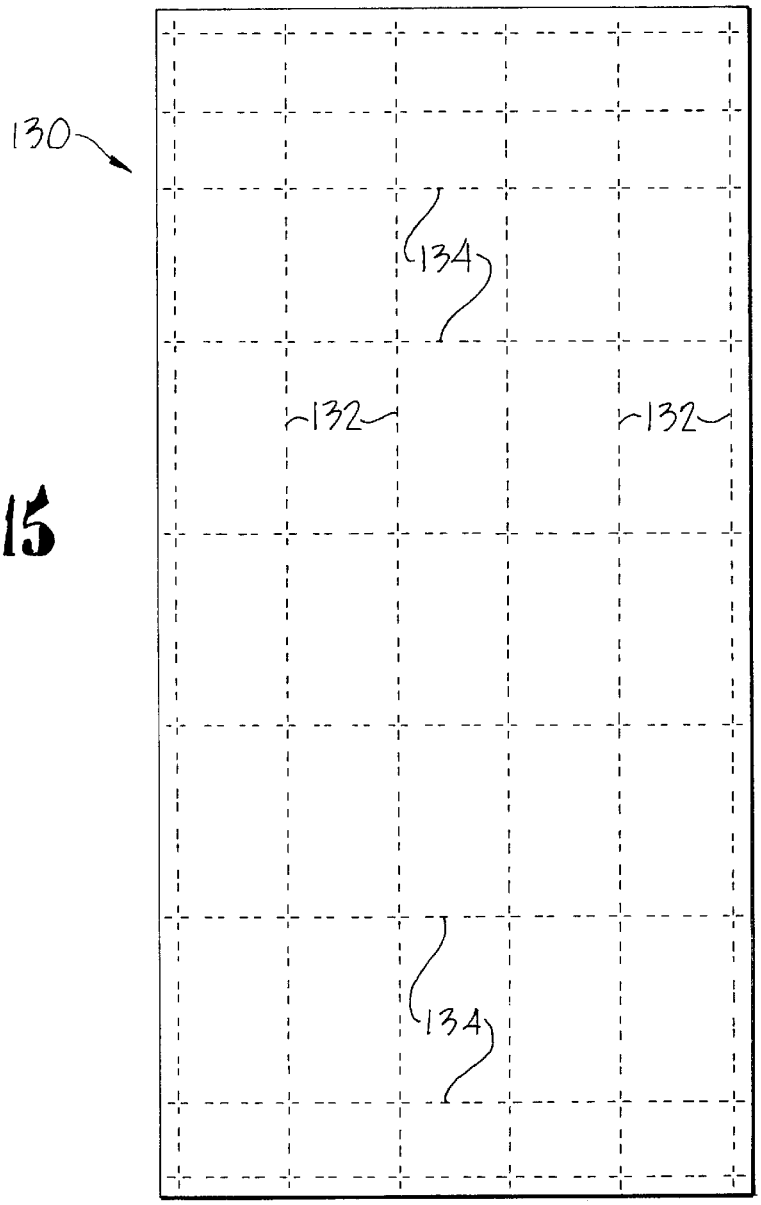
Fig. 15

WEB CORE STRUCTURAL PANEL

CROSS-REFERENCE TO RELATED APPLICATION

This application is a continuation-in-part of application Ser. No. 09/441,706 filed Nov. 16, 1999.

FIELD OF THE INVENTION

This invention relates to a multi-purpose panel system which is assembled from precision-made components and has superior mechanical properties. More specifically, the panel system is lightweight and very stiff or self-supporting, utilizes components formed from sheet material and has a low cost of assembly.

BACKGROUND OF THE INVENTION

Various types of sandwich construction panel systems are known. However, these typically employ relatively heavy internal frame components such as channel members and the like that are bent or otherwise formed to the required shape. Also, such systems may be adapted or have been developed for use only in a specific application, such as for aircraft fuselage paneling.

Sandwich flooring systems in present use may have other disadvantages. For instance, they may require a structural underframe to provide sufficient support, depending upon the load to be carried or supported. Other sandwich configurations may have adequate stiffness or rigidity for floor or wall system applications, but they are typically relatively heavy and difficult to assemble.

SUMMARY OF THE INVENTION

Accordingly, a primary object of the subject invention is to provide a lightweight and strong structural panel system including first and second spaced skins and a web core therebetween constructed from sheet material that secures the skins together in a spaced relationship and provides an interlocked supporting grid between the skins.

Another important object of the subject invention is to provide a panel system as aforesaid having a web core that includes a plurality of spaced apart longitudinal and transverse core members which are precision formed of either metal or rigid plastic to fit easily together and thereby present a stiff, rigid, self-supporting structure.

Still another important object is to provide such a panel system of metal construction having core members provided with longitudinally spaced projections which extend through openings in the panel skins to provide self-fixturing during assembly and welded connections in the final product.

Yet another important object is to provide the aforesaid metal panel system with twin projections or tabs at each welded connection to the skins so that one tab may be used to secure the skins and core together in a fixed relationship at a connection site while welding is initiated at the other tab, whereby conductive metals such as aluminum may be welded without the need for elaborate fixtures during assembly.

Furthermore, another important object of the subject invention is to provide a panel system which, in addition to superior strength and rigidity, has good insulation properties and provides an interior core space that can be used as a duct for fluid flow, evacuated to provide a partial vacuum, or filled with a liquid, particulate material or other fluid as desired for a particular system application.

Another object is to provide such a panel system in which the components thereof may be assembled and produced with close tolerances utilizing simple tooling, thereby assuring that panel sections will be uniform so that they can be readily joined together to present a composite structure of the desired physical size.

Another object is to provide a panel system that is usable in a variety of applications, such as in the construction of any type of cargo carrier (e.g., railroad cars, aircraft and ships), general purpose enclosures and structures, storage tanks and the like.

Still another object is to provide a panel system usable for a variety of purposes, such as wall paneling, flooring, and applications requiring structural reinforcement, superior insulation properties and/or ductwork provided within the panels themselves.

Still another object of the subject invention is to provide a paneling system that when used as flooring does not require a structural underframe.

Still another object is to provide a structural system composed of panel sections which are relatively small and easy to handle, and which are readily connected together to provide a final structure of the desired size and configuration.

Yet another important object of the subject invention is to provide such a paneling system that is strong, rigid, lightweight and easy to assemble as aforesaid, and which does not require the use of mechanical connectors.

These objects are attained by providing a paneling system comprising a first skin, a second skin, a web core of sheet material construction for supporting the skins in a spaced relationship, and means for securing the panel components together while providing self-fixturing during fabrication of the panel. The web core includes a plurality of spaced apart longitudinal members having longitudinally spaced singular or twin projections or tabs extending therefrom and transversely aligned, longitudinally spaced slots therein, and further includes a plurality of spaced apart, transverse cross members of similar configuration each having spaced slots therein receiving the longitudinal members at corresponding transversely aligned slots thereof to provide an interlocked grid between the first and second skins. The projections or tabs on the members extend through slits in the skins to provide a means to precisely locate the components during assembly and to join the core and skins together by welding when metallic material s are utilized.

BRIEF DESCRIPTION OF THE DRAWINGS

FIG. 14 is an enlarged, fragmentary elevational view of a portion of a core member in a second embodiment of a panel section of the present invention.

FIG. 15 is a plan view of a representative top skin of the second embodiment showing a pattern of slits for receiving twin Labs projecting from the web core, the bottom skin being identical thereto.

DETAILED DESCRIPTION

Figure 1:
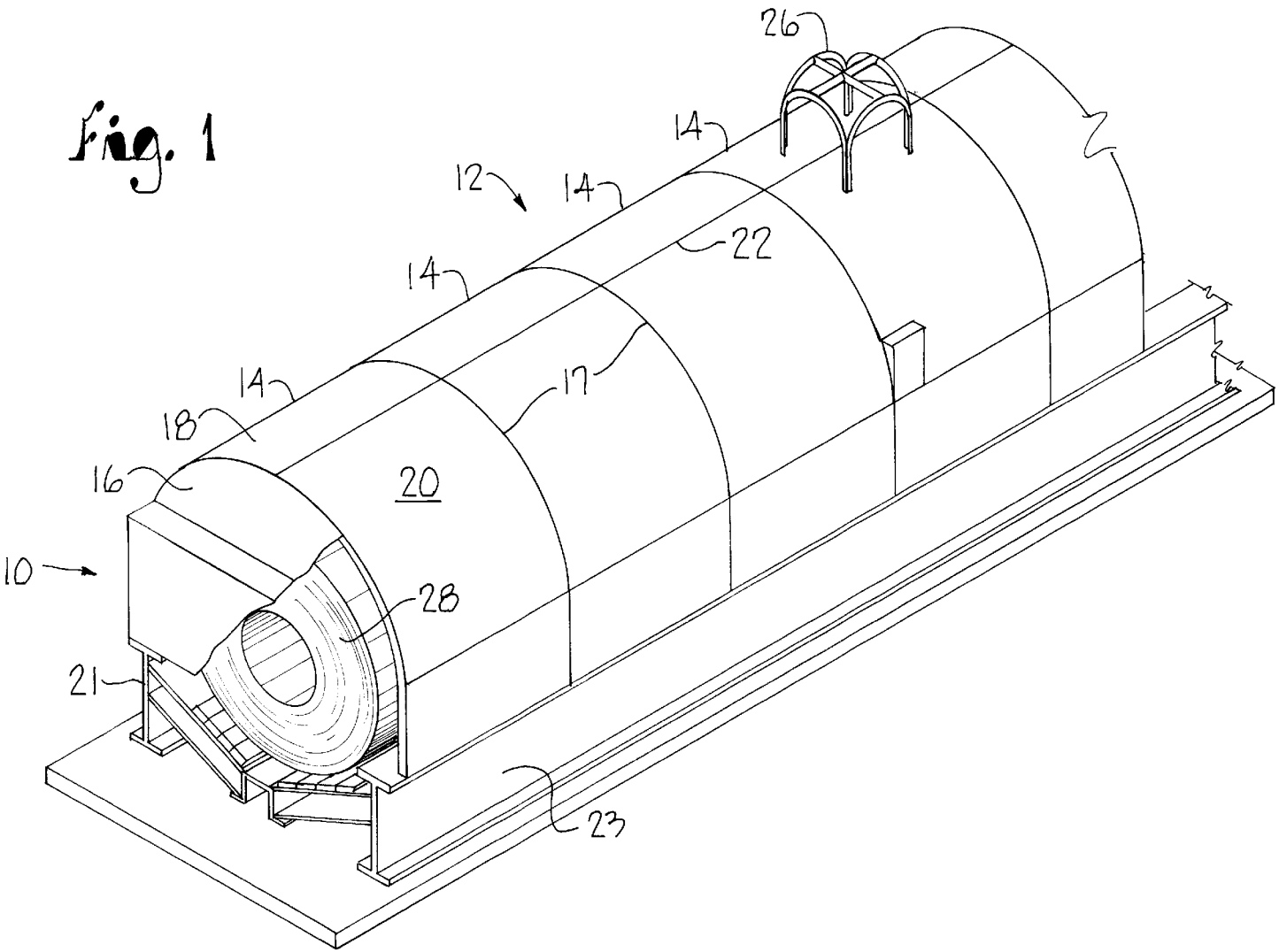
FIG. 1 is a fragmentary, perspective view of a railroad coil car with the coil cover constructed using the panel system of the present invention and with an end broken away to show the coil thereunder.

As shown in FIG. 1, a railroad coil car 10 includes a coil cover 12 thereover, constructed using the structural panel system of the present invention. Although each figure depicts the panel system as forming such a coil cover 12, it should be understood that the panel system has many applications and uses in structures of various types, as discussed above.

Figure 2:
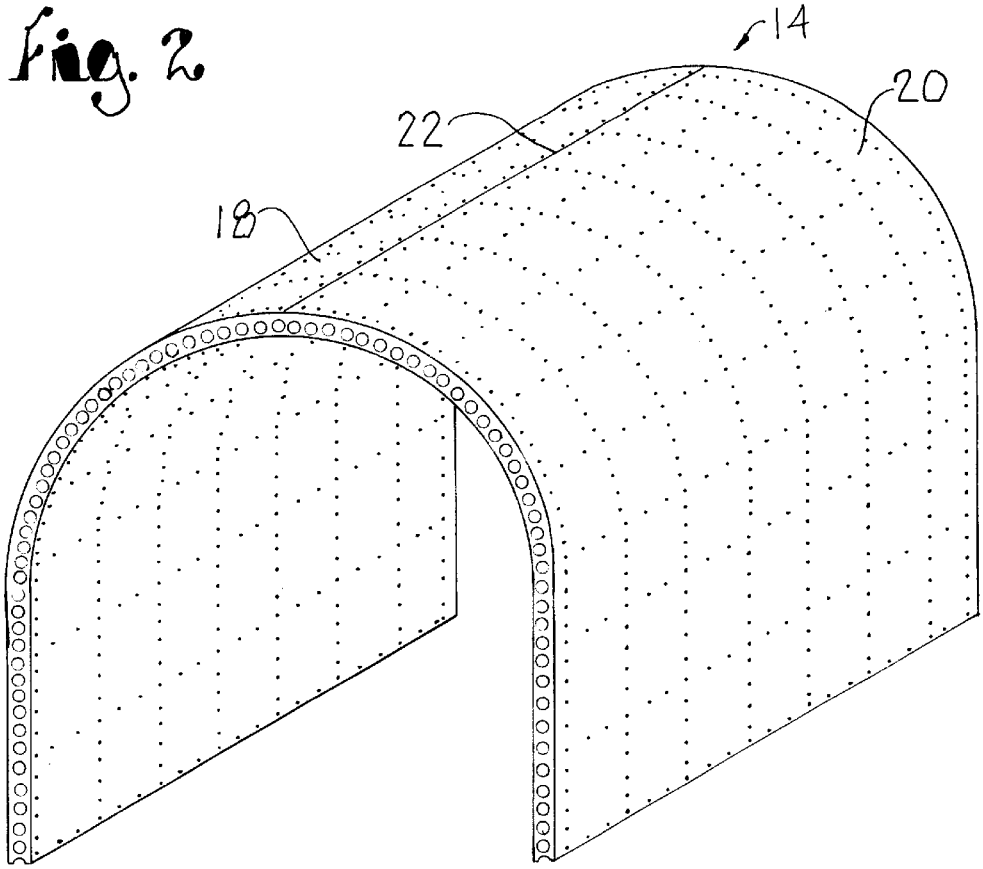
FIG. 2 is a perspective view of one panel section of the coil car cover of FIG. 1.

The coil cover 12 is formed of a plurality of end-to-end sections 14 and end panels 16 (only one shown) secured together. Adjacent sections 14 are secured at their end surfaces to form transverse seams 17. Each section 14 includes two halves, a left and right half 18 and 20, joined together along its top surface to form a central longitudinal seam 22. Left halves 18 are constructed virtually identically to right halves 20, the only difference being that left halves 18 are made as mirror images of right halves 20. FIG. 2 shows a single panel section 14 constructed accordingly.

As shown in FIG. 1, each half 18 and 20 is secured along its bottom surface to the longitudinal side members 21 and 23 of the coil car 10. End panels 16 (only one shown) are secured over the open ends of the first and last panel sections 14 and are preferably constructed to include a stacking ledge 24. Upon removal of the coil cover 12 at lifting cage 26 from over the coil 28, covers may be vertically stacked for efficient storage thereof. An advantage of the cover 12 of the present invention is that its rigidity, particularly its longitudinal stiffness, permits cover 12 to be lifted by a hoist coupled thereto at cage 26, stacked and reused repeatedly without damage or deformation Of the cover 12.

FIGS. 3 and 6–11 depict the construction steps employed in forming a panel section half 30 of the type described above with respect to halves 18 and 20 of each section 14. Half 30 in a first embodiment of the present invention includes a top skin or plate 40, a web core member 42 and a bottom skin or plate 44. Top and bottom skins 40 and 44 are thin, flexible metal sheets with rows of evenly spaced rectangular slits 46 therethrough, except that every fifth row of slits 46 is cross-shaped. The web core 42 is an interlocked grid formed of evenly spaced longitudinal or primary members 48 and transverse cross members 50 preferably laser cut or punched from sheet stock using cutting or punching equipment with computer controls. The sheet material may be steel having a thickness of 1/16th inch, or thinner or thicker depending upon the material and the properties desired.

Figure 5:
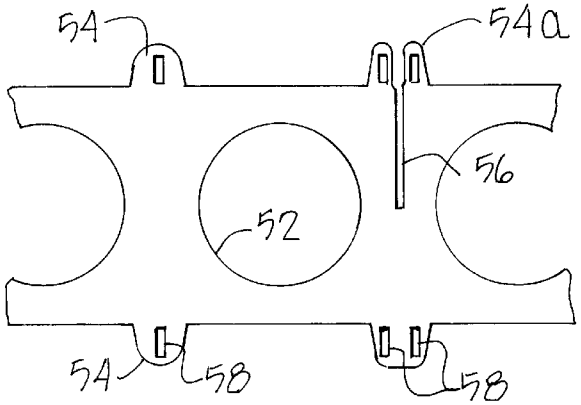
FIG. 5 is an enlarged, fragmentary elevational view of a portion of a longitudinal member of the web core of FIG. 3.

As shown in detail in FIG. 5, each longitudinal member 48 has circular openings 52 therein to reduce its weight, and pairs of opposed projections or tabs 54 that extend upwardly and downwardly from the member 48 at regularly spaced intervals. every fifth upwardly extending tab **54*a* has an open slot 56 for insertion of a transverse cross member 50. The slots 56 extend through the center of the corresponding tab 54*a* into the longitudinal member 48. The projections 54 and 54*a* also preferably have rectangular openings 58** therein for easier removal thereof.

Figure 4:
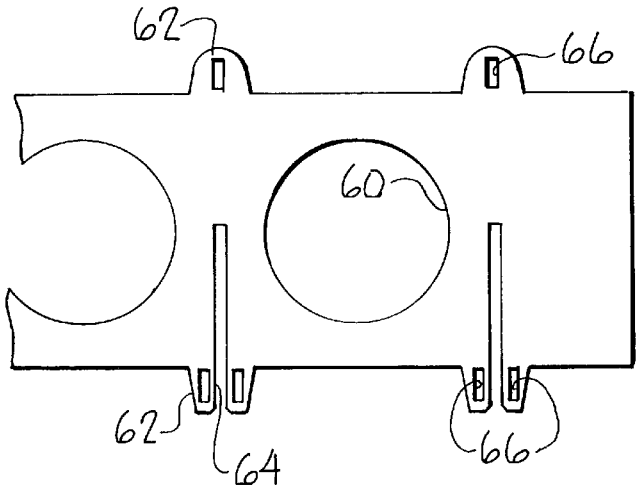
FIG. 4 is an enlarged, fragmentary elevational view of a portion of a transverse cross member of the web core of FIG. 3.
Figure 3:
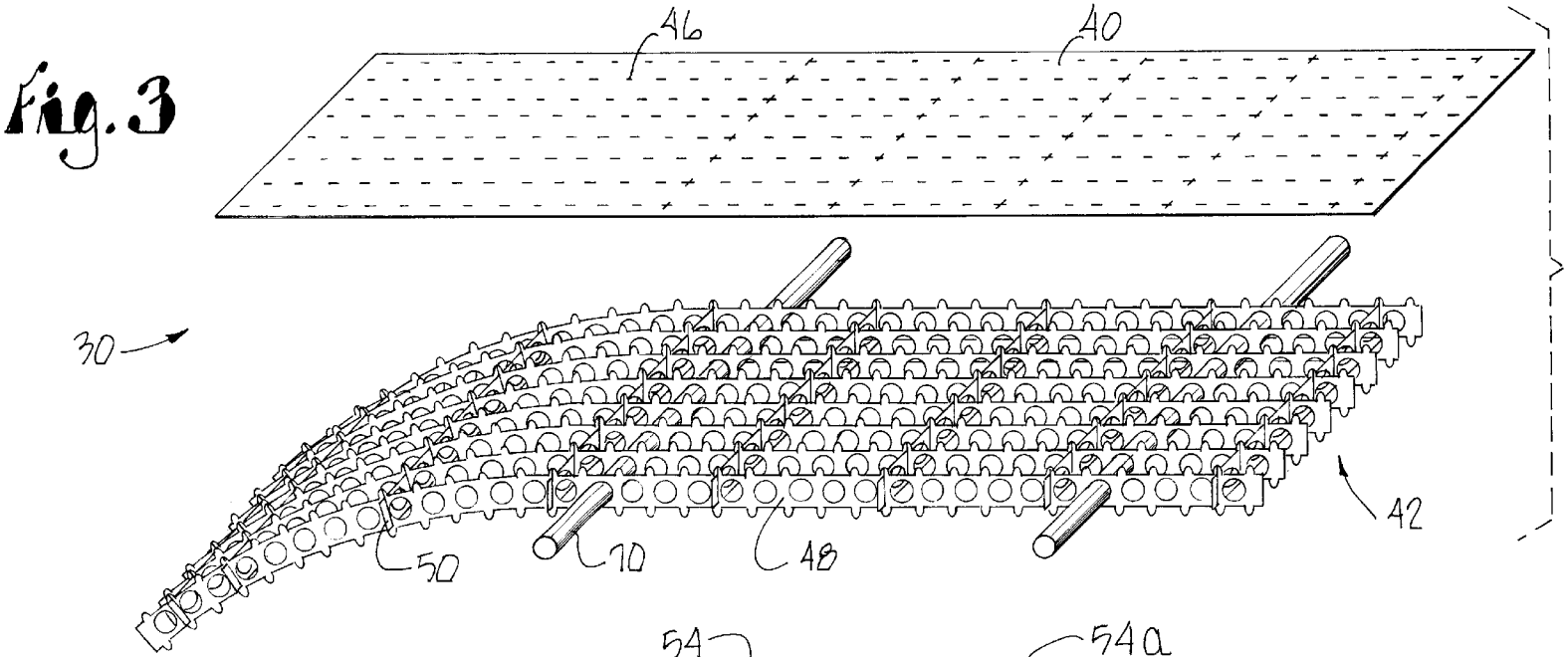
FIG. 3 is an exploded perspective view of the top skin and the web core of the left half of a first embodiment of a panel section in accordance with the present invention, illustrating the panel section under assembly.

As shown in detail in FIG. 4, each transverse cross member 50 also has circular openings 60 therein to reduce its weight and pairs of opposed projections or tabs 62 that extend upwardly and downwardly from the member 50 at regularly spaced intervals. Every downwardly extending projection 62 has an open slot 64 for insertion of a longitudinal member 48. The slots 64 extend through the center of the corresponding projection 62 into the transverse cross member 50 The projections 62 have rectangular openings 66 therein to facilitate assembly of panel half 30. The projections 54 and 62 of longitudinal and transverse members 48 and 50 are spaced an equal distance apart.

In addition to weight reduction, it should be appreciated that the openings 52 and 60 in the members 48 and 50 also intercommunicate the core spaces defined by the grid to provide an open interior within the panel. This interior space may be advantageously utilized to provide a duct or channel in the panel, a continuous space for electrical or mechanical runs and/or insulation or other fillers as required by a particular application, or an interior chamber that may be pressurized or evacuated or used for other purposes as desired.

To assemble the web core 42, the desired number of longitudinal members 48 are evenly spaced parallel to one another in their desired configuration with projections 54*a* having slots 56 formed therein being aligned. Longitudinal members 48 May be held in position by a simple jig such as dowels 70 secured by clamps 72 to a table 74 or other surface. See FIGS. 3 and 6. Transverse cross members 50 are then inserted at their slots 64 into the slots 56 of the longitudinal members 48. Thus the longitudinal members 48 present rows and the transverse cross members 50 present columns of the web core 42. Together they form a grid much in the same manner as partitions of egg crates or boxes for bottled goods.

Figure 6:
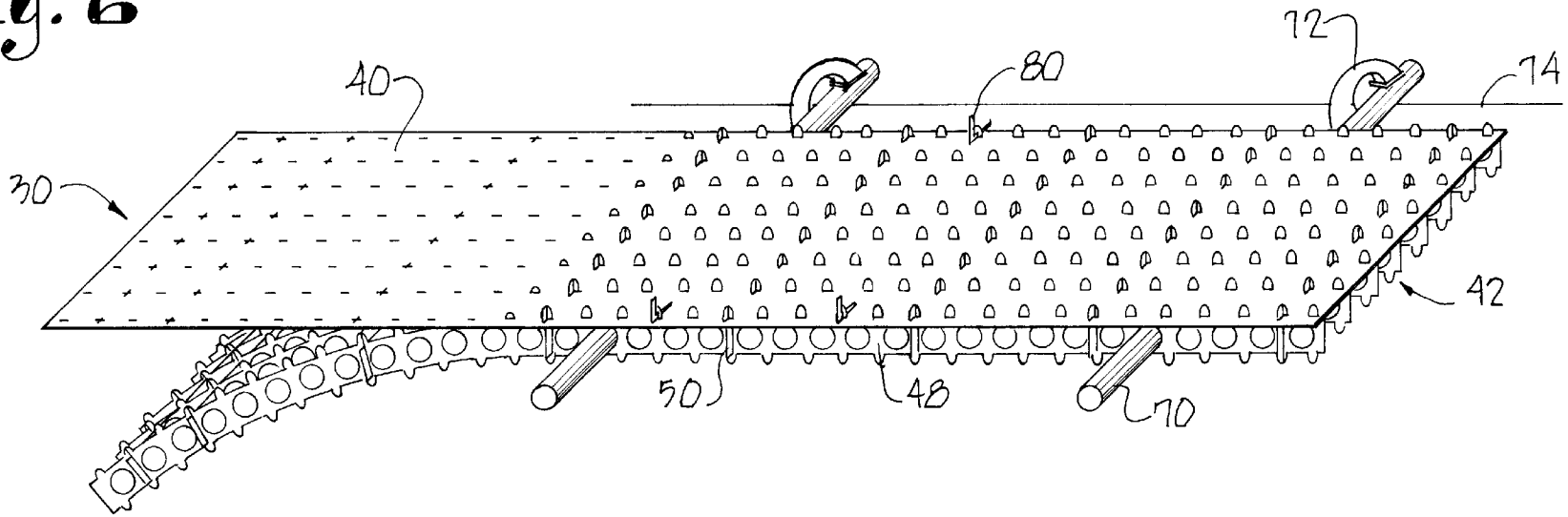
FIG. 6 is a perspective view of the left half illustrated in FIG. 3, showing the top skin being secured by wedge members to the web core thereof.
Figure 8:
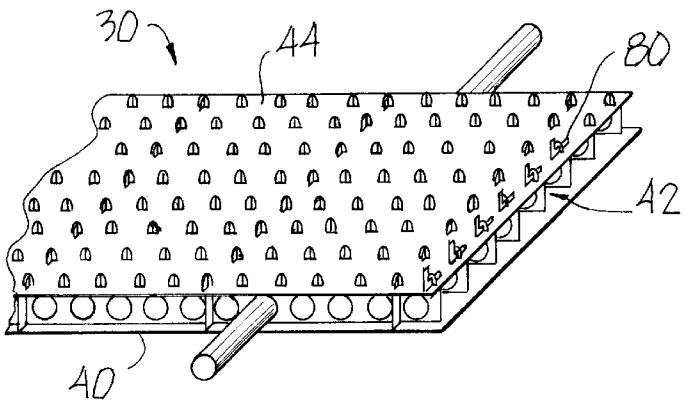
FIG. 8 is a partial perspective view of the left half of FIG. 3 as inverted to show the bottom skin being secured to the web core.
Figure 11:
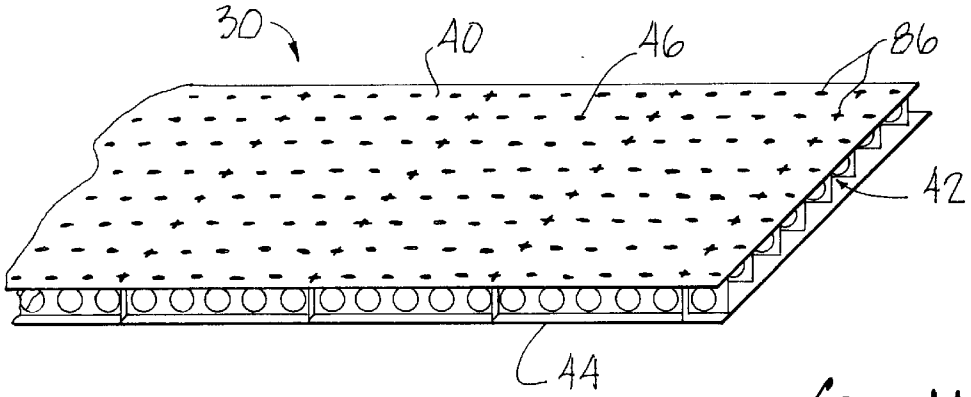
FIG. 11 is a partial perspective of the left half of FIG. 3 showing the panel section assembled.
Figure 7:
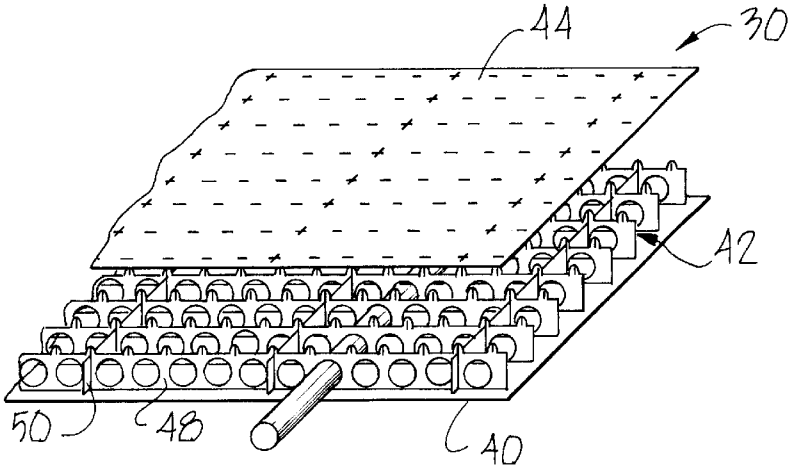
FIG. 7 is a partial exploded perspective view of the left half of FIG. 3 as inverted to show the bottom skin and the web core thereof.

The top and bottom skins 40 and 44 are mounted to the web core 42 with projections 54 and 62 and their corresponding openings 58 and 66 extending through the slits 46 of the skins. In this regard, FIGS. 6 and 8 show the top and bottom skins 40 and 44 being mounted to the web core 42.

Figure 9:
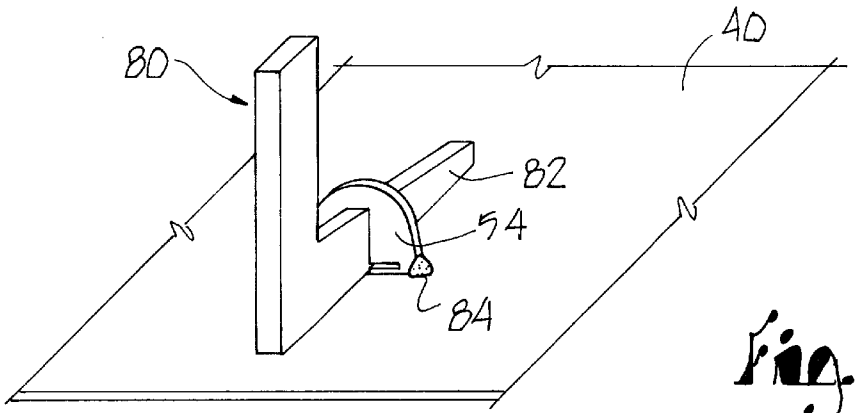
FIG. 9 is a detail view in perspective of a wedge member securing the top skin to the web core, in accordance with the first embodiment of the present invention.
Figure 10:
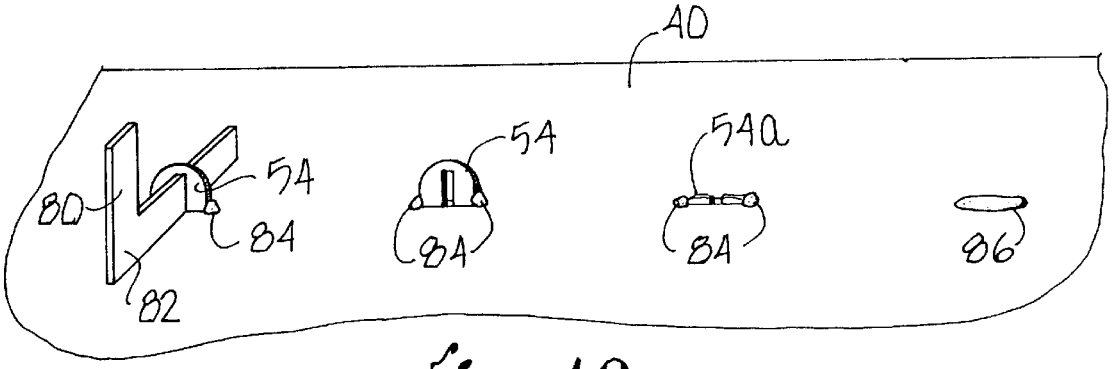
FIG. 10 is a detail view in perspective illustrating the removal of a web core tab and completion of welding, in accordance with the first embodiment of the present invention.

As shown in detail in FIGS. 9 and 10, the skins 40 and 44 are secured to the web core 42 by securing wedge 80 which have a leg 82 that fits snugly within the rectangular openings 58 and 66 of the projections 54 and 62. The projections 54 and 62 are secured at their corners to the corresponding skin 40 or 44 by tack or spot welds 84. The wedges 80 may then be removed, the projections 54 (shown in detail) and 62 (not shown in detail) broken off, see broken projection 54*a* in FIG. 10, and the weld line 86 completed. Bonding methods other than welding may also be used, such as sufficiently strong adhesives. Alternatively, wedges 80 may be placed within the openings 58 and 66, then clamps, such as clamps 72, may be tightened around the skins 40 and 44, the wedges 80 may be removed and the projections 54 and 62 may be welded or otherwise bonded to the skins 40 and 44.

Projections, such as projections 54 and 62, may be used with securing members other than wedges 80, and rectangular slots 58 and 66 therein are not required. For example, wedges 80 may be replaced with a metal strapping system or other sufficiently strong clamping systems.

Figure 12:
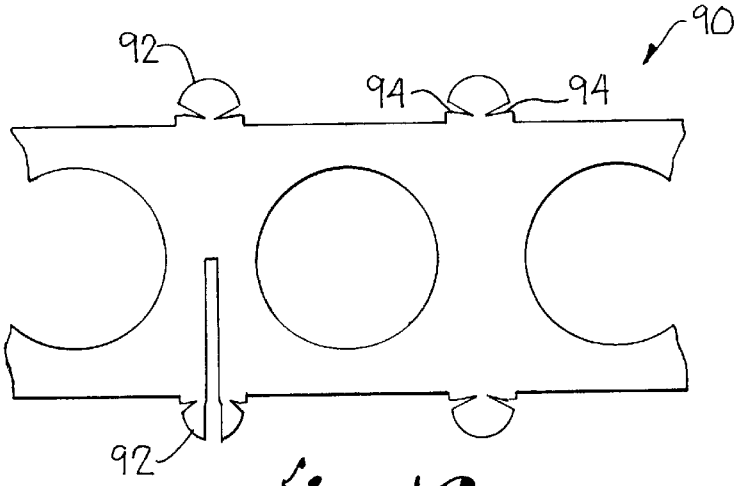
FIG. 12 is an enlarged, fragmentary elevational view of a portion of a modified form of the transverse cross member of FIG. 4, in accordance with the present invention.

FIG. 12 shows a modified form of a transverse cross member 90. It is similar to the transverse cross member 50 but includes differently formed projections 92. Each projection 92 has a pair of opposed twist-off slots 94 extending therein near the base of the corresponding projection 92.

Twist-off slots 94 facilitate the removal of the projections 92 from the transverse cross member 90 and eliminate the need for securing wedges 80. Thus, as shown, the projections 92 do not include slots, such as rectangular slots 58 or 66 of longitudinal and transverse cross members 48 and 50. In use, the twist-off slots 94 allow the projections 92 to be rotated or twisted 90° into a locking position, securing the web core to the plates. After welding or otherwise bonding the projections 92 to the corresponding skin, the projections 92 can be rotated further until they fail and break off. Of course, projections extending from longitudinal members 48 may be similarly configured.

The web core with projections or tabs as discussed above provides the ability to attach the web core to full skins (i.e., skins without securement access holes) from the panel's exterior and yet assemble panels that could be otherwise inaccessible from the edges given their small width.

Although it is possible to build very large single panels using metal skins directly from the supply coil up to about 10' wide (e.g., a single 10'×100' panel), it is more likely to be preferable to construct several panels and connect them together as desired. For example, twenty 5'×10' panels could be connected together to make a larger panel of the required size. Thus, the panel-to-panel connection system for factory or on-site assembly is important to the overall system.

Figure 13:
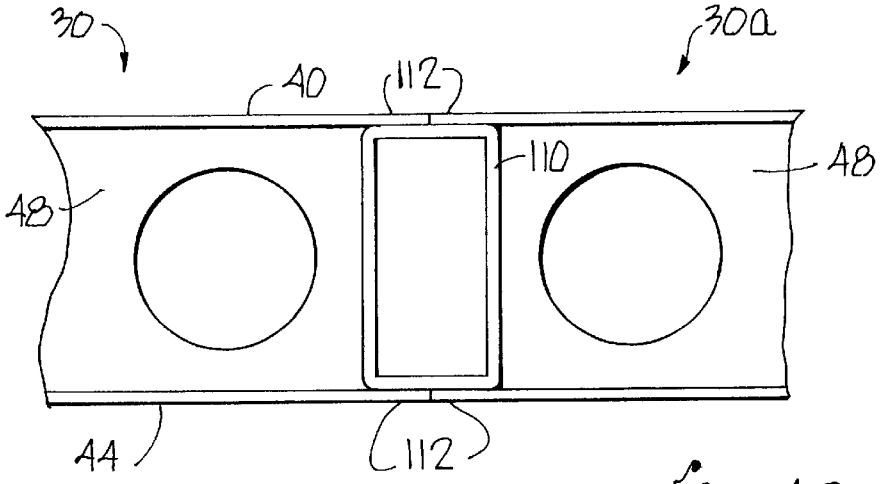
FIG. 13 is a detail view of a joint for securing left and right panel halves of the present invention together to form a panel section.

Now referring back to the drawings in this regard, two panel section halves, one being similar to half 30 and the other a mirror image thereof 30*a*, may be joined or secured together as in FIG. 13, The longitudinal seam 22 of FIG. 1 represents these joints.

As shown in FIG. 13, the joint between the halves 30 and 30*a* is formed by a rectangular tube 110 inserted between the skins 40 and 44 of the panel halves into abutment with the ends of the longitudinal members 48, with one half of the tube 110 extending into each panel half 30 and 30*a*. Abutting skin edges 112 are welded to the tube 110 along the tube at the top and bottom.

Referring to FIGS. 14–20, the skin and web core construction of a second embodiment of a panel section of the present invention are shown. A grid member 120 of the web core is shown in FIG. 14 and is very similar to the longitudinal and cross members 48 and 50 of the first embodiment, in that it comprises an elongated strip of sheet material having circular openings 122 therein to reduce its weight, and spaced, open slots 124 for insertion of orthogonally disposed core members (not shown in FIG. 14) to complete the grid configuration. In the second embodiment, all of the members of the web core are of identical configuration, whether extending longitudinally with respect to a panel or transversely thereof. The orientation in the drawings of member 120 in FIG. 14 is that of a transverse member as in FIG. 4 of the first embodiment, it being understood that primary or longitudinal members would be inverted with their slots 124 extending from their upper edges so as to receive the transverse members and form the grid.

The web core of the second embodiment utilizing members 120 is particularly suited for panels of aluminum construction, a preferred material being aluminum sheet stock having a thickness of 0.090 inch. A greater thickness may be employed, of course, as dictated by a particular application. Aluminum is highly conductive and thus the first embodiment is less suited to aluminum fabrication because of the difficulty in reliably welding the web core to the skins in the manner depicted in FIG. 10 and described hereinabove. The configuration of member 120 provides reliable assembly of aluminum components without separation of the skins from the core by providing pairs of projections or tabs 126 and 128 that extend upwardly and downwardly (as viewed in FIG. 14) from the longitudinal edges of member 120 at regularly spaced intervals. Each of the tabs 126 is similar to tabs 54 and 62 in the first embodiment, but tab 128 is significantly shorter. Each of the transverse slots 124 is centered between a corresponding tab pair 126, 128, and it may be noted that the shorter tab 128 of each pair on one longitudinal edge is aligned with the longer tab 126 of the tab pair on the opposite longitudinal edge. The spacing between slots 124 is not critical as it is determined by design requirements as to the distance between adjacent parallel core members dictated by panel weight and load requirements.

FIG. 15 is a plan view of a top skin 130 showing the pattern of slits for receiving the twin tabs 126–128 projecting from the top edges of the core members 120. Six longitudinally extending lines of slits 132 are illustrated, intersected by nine parallel transverse lines of slits 134. Closer spacing of the transverse lines 134 at the ends of the top skin 130 illustrate the use of closer spacing to facilitate assembly of curved panels in that more closely spaced lines of connection more readily follow changes in the curvature of the panel. The bottom skin 131 (shown fragmentarily in FIG. 20) is identical to top skin 130.

Figure 16:
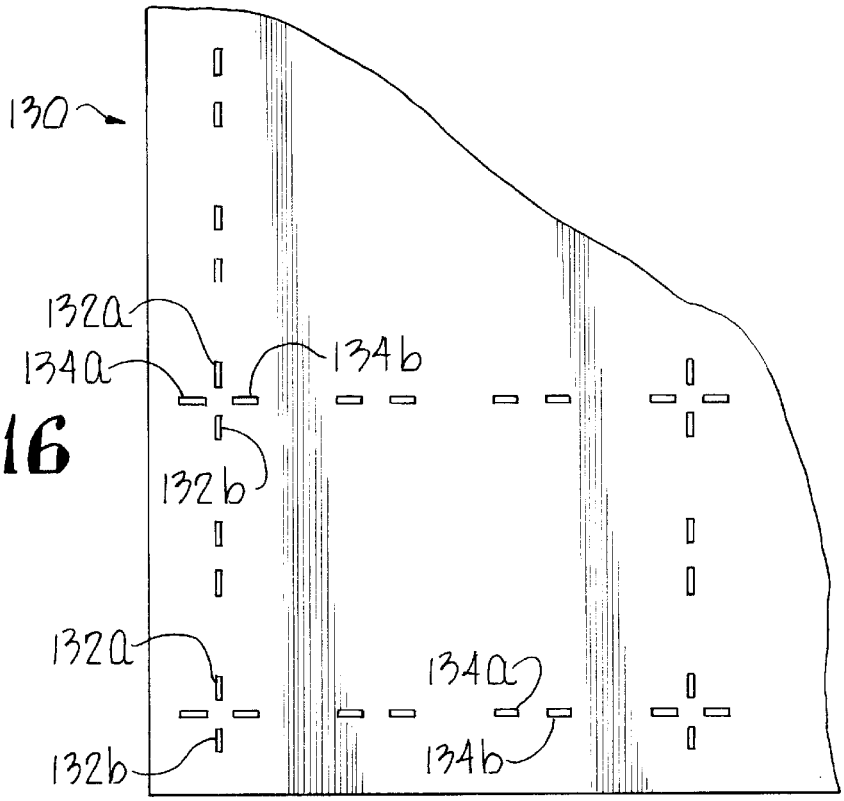
FIG. 16 is an enlarged, fragmentary plan view of the top skin showing the tab-receiving slits in greater detail.

The enlarged plan view of a portion of top skin 130 in FIG. 16 shows that the lines of slits are formed by pairs of narrow rectangular openings 132*a* and 132*b* in the longitudinal direction, and 134*a* and 134*b* in the transverse direction. When longitudinal and transverse lines of slits intersect, four such openings 132*a*, 132*b*, 124*a* and 124*b* are presented.

Figure 17:
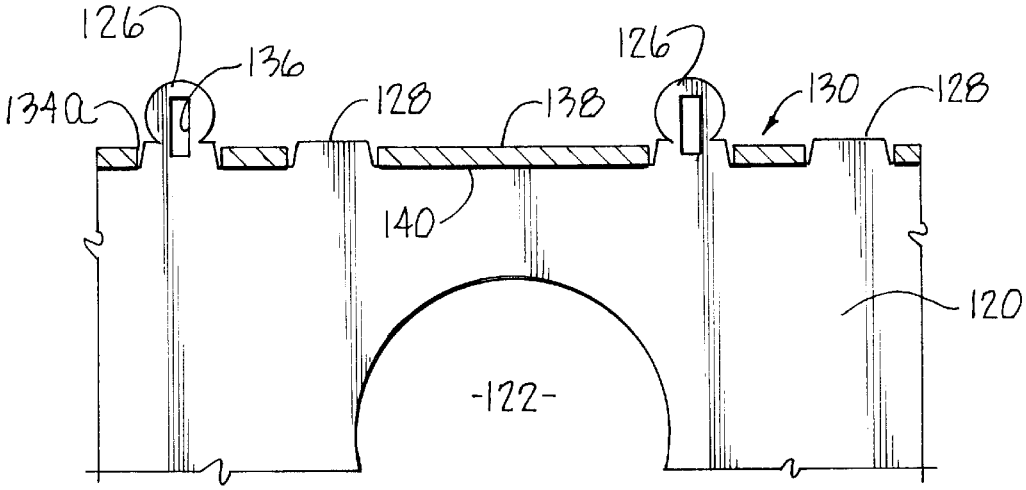
FIG. 17 is an enlarged, fragmentary cross-section showing the twin tabs of the second embodiment received by slits in the top skin upon assembly of the components but prior to welding.

FIG. 17 shows the manner in which tabs 126 and 128 are received by the corresponding pairs of openings or slits in each of the skins. It may be appreciated that the shorter tab 128 provides a stub that extends through the thickness of the skin and projects a short distance, whereas the longer tab 126 projects well above the exterior surface 138 of the skin 130 so that opening 136 therein is accessible at the exterior surface 138. This relationship of the parts shown in FIG. 17 for top skin 130 is the same for the bottom skin 131 (not illustrated).

Figure 18:
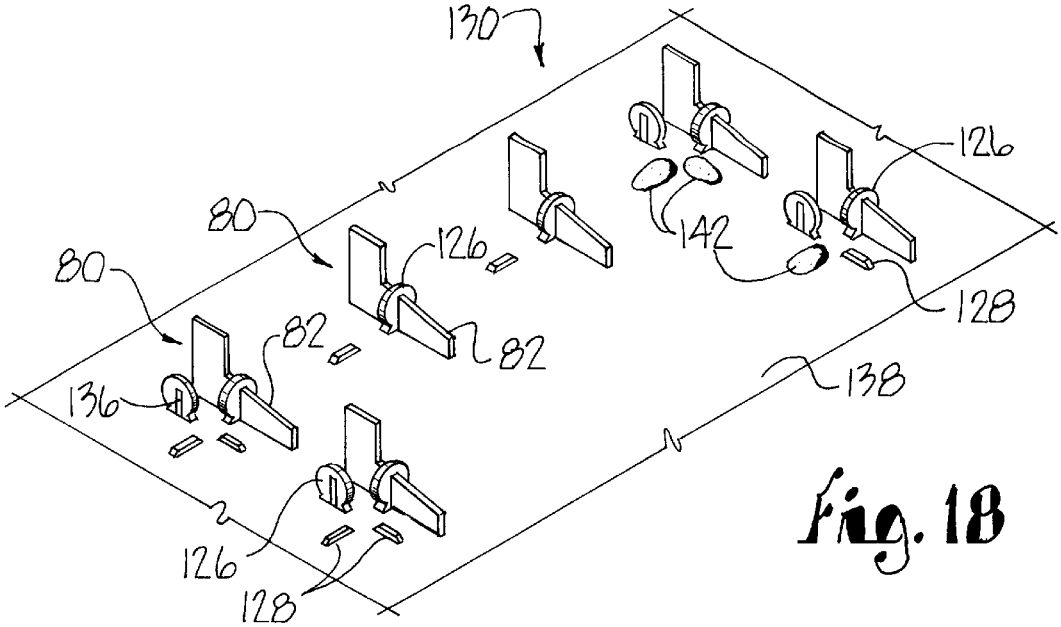
FIG. 18 is a fragmentary perspective view showing the top skin of an assembled second embodiment with wedge members inserted in the longer tabs to secure the top skin to the web core, and illustrating a stage of assembly where three of the shorter tabs have been joined to the top skin by welding.

Assembly of the panel components is accomplished in the same manner as described above with respect to the first embodiment and as illustrated in FIGS. 3, 6–8 and 11. In the final stage of assembly wedges 80 are inserted in the openings 136 in the longer tabs 126 extending through the top and bottom skins, as illustrated in FIG. 18 where a portion of top skin 130 is shown. It will be appreciated that with the tapered legs 82 of wedges 80 fully inserted in tab openings 136, the skin 130 is held on the web core with its interior surface 140 in engagement with the underlying longitudinal edges of the grid members 120 as shown in the fragmentary cross section of FIG. 17. Likewise, the bottom skin 131 in the second embodiment is held in engagement with the web core by wedges 80 as illustrated in FIG. 8 for the first embodiment.

Figure 19:
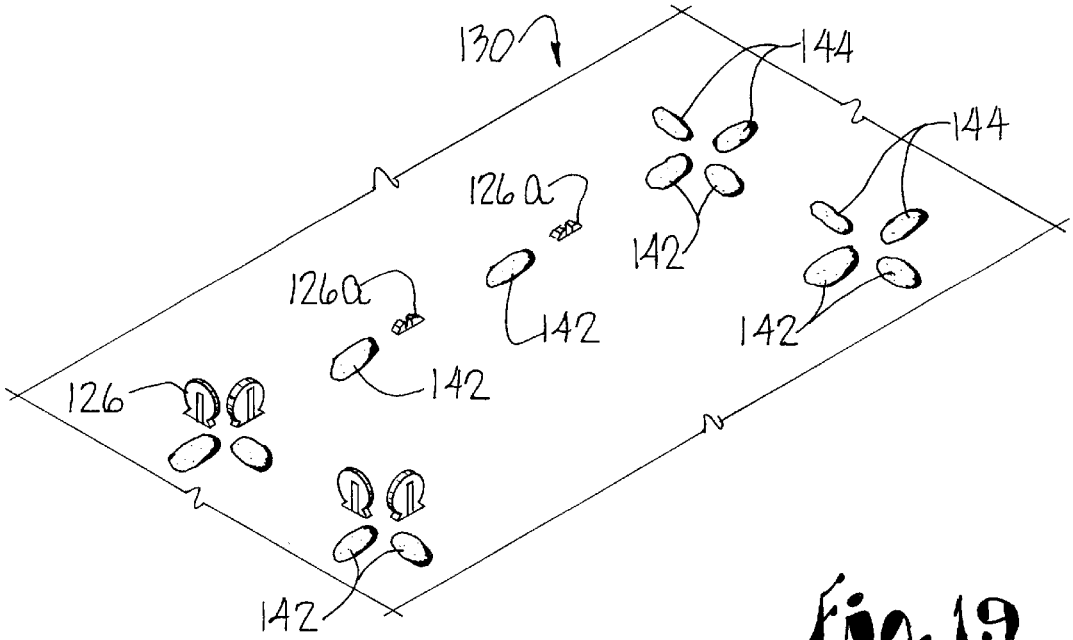
FIG. 19 is a view similar to FIG. 18 but showing a subsequent stage of fabrication where additional weld lines have been completed.

FIGS. 18 and 19 illustrate the final step in fabrication of the panel section in which the skins are welded to the web core. This is accomplished for top skin 130 as shown in FIG. 18 where it may be seen that welds 142 join the skin 130 to the web core at the shorter tabs 128. FIG. 19 illustrates further progress in completing the welding and shows additional welds 142 at the shorter tabs 128 plus welds 144 at certain of the longer tabs 126. As in the first embodiment, the longer tabs 126 are broken off in preparation for welding as illustrated by the shortened tabs 126*a*.

The twin tab arrangement is particularly advantageous in forming aluminum panels which may be preferred in a given application due to their light weight and relatively high strength. Welding is more difficult due to the high conductivity of aluminum, and thus the twin tabs permit welding at each joint with the assurance that an adjacent weld will not melt and permit the skin to separate from the core. The wedges 80 or other holding means on the longer tabs assure that the skin will remain fast to the web core, and the spacing between the two tabs assures that when the longer tab is broken off and welded, the adjacent weld at the shorter tab will remain intact. Furthermore, the arrangement has the advantage of providing four welded joints at each intersection of the longitudinal and transverse grid members as may be appreciated from the enlarged view of a portion of the slit pattern in FIG. 16.

Figure 20:
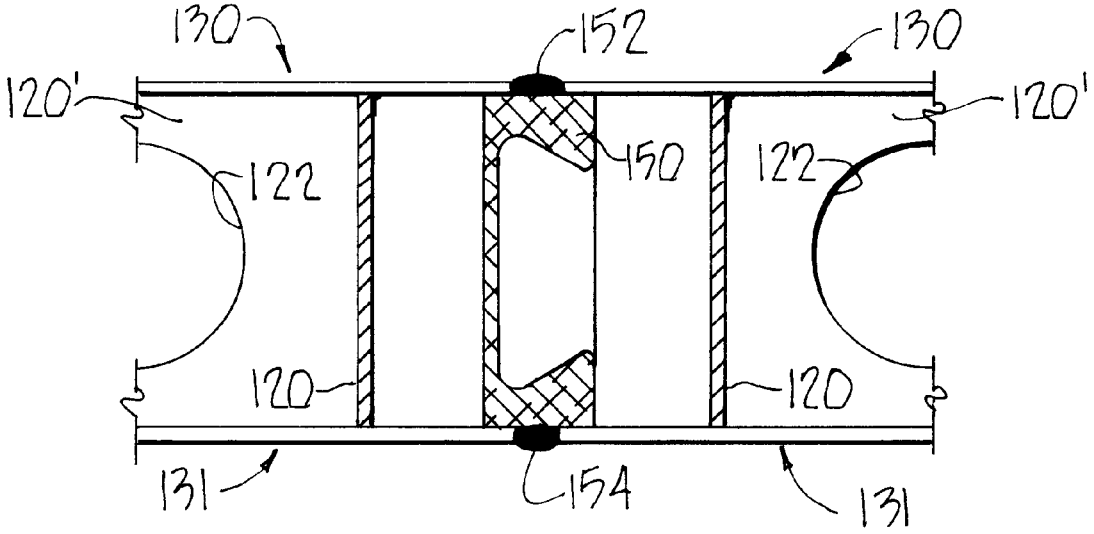
FIG. 20 is a detail view of a joint for securing adjacent panel sections together, particularly the second embodiment of FIGS. 14–19.

Aluminum panel sections are secured together at their edges much in the same manner as in FIG. 13, as illustrated in FIG. 20 where a preferred joint is shown for securing adjacent aluminum panel sections. An extruded aluminum channel 150 is shown in transverse cross section inserted between the skins 130 and 131 and abutting the ends of the longitudinal members 120' of the adjacent panel sections. Weld lines 152 and 154 join the edges of adjacent top skins 130 and bottom skins 131 along the entire length of channel 150.

Figure 21:
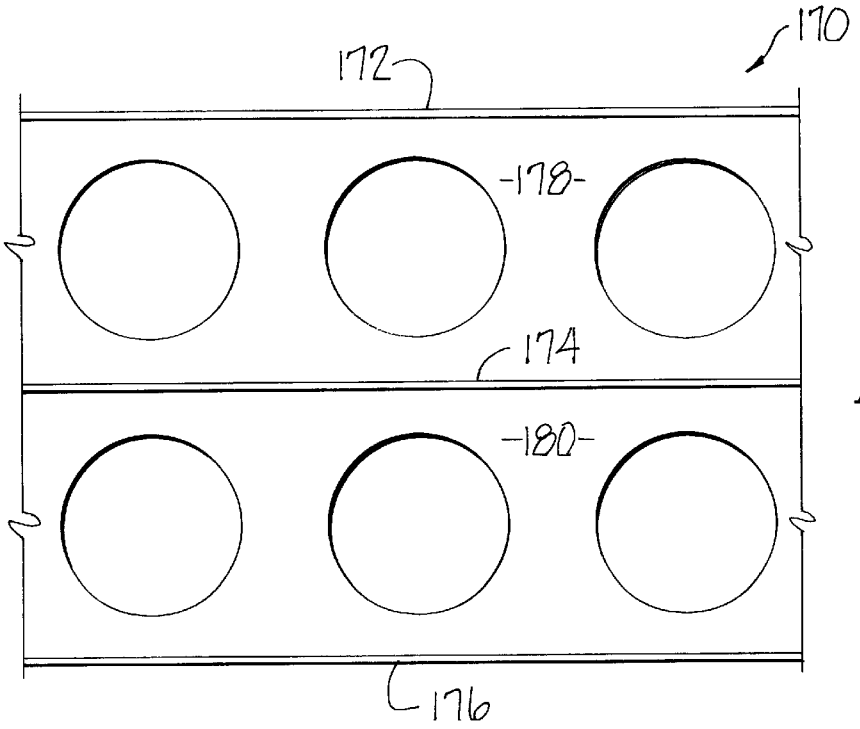
FIG. 21 is a partial elevational view of an alternative three skin configuration of the panel system in accordance with the present invention.
Figure 22:
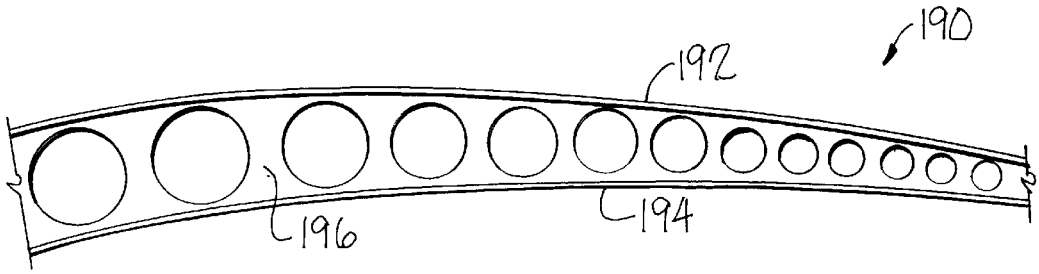
FIG. 22 is a partial elevational view showing the paneling of the present invention having a progressively varying width.

FIGS. 21 and 22 show alternative configurations of the paneling system. The panel 170 of FIG. 21 provides a double wall of protection (such as against leakage in fluid storage tanks) and includes three skins 172, 174 and 176 secured together by two web cores 178 and 180 as previously described herein. The panel 190 of FIG. 22 is very similar to panel half 30 but has its skins 192 and 194 secured together by a web core 196 of a progressive decreasing width as viewed from left to right. Thus, these figures further illustrate the panel system's adaptability for a variety of applications.

Having thus described the invention, what is claimed as new and desired to be secured by Letters Patent is as follows:

1. A structural panel comprising:

first and second metal skins each presenting exterior and interior panel surfaces, a web core of metal construction between said first and second skins in engagement with said interior surfaces thereof to maintain the skins in a spaced relationship, including a plurality of spaced-apart, elongated primary members having longitudinally spaced connectors extending therefrom and further having transversely aligned, longitudinally spaced slots therein, said web core further including a plurality of spaced-apart cross members each having spaced slots therein receiving said primary members at corresponding transversely aligned slots thereof to provide an interlocked grid between said first and second skins, at least certain of said connectors including a pair of spaced projections, and said skins having openings therein receiving corresponding projections, and welds at said projections securing said web core to the respective skins to provide a rigid panel structure.

2. The structural panel as claimed in claim 1, wherein each of said primary and cross members is composed of a sheet material of desired thickness.

3. The structural panel as claimed in claim 2, wherein said skins and said sheet material are aluminum.

4. The structural panel as claimed in claim 1, wherein said cross members include spaced connectors extending therefrom, at least certain of said connectors extending from the cross members including a pair of spaced projections, said skins having openings therein receiving corresponding projections on the cross members, and there being welds at said cross member projections securing the cross members to the respective skins.

5. The structural panel as claimed in claim 1, wherein at least certain of said pairs of spaced projections comprise two spaced tabs, one of which has means for cooperating with a holding device during fabrication while the other tab is welded to the associated skin.

6. The structural panel as claimed in claim 1, wherein at least certain of said pairs of spaced projections comprise an initially relatively long tab and a short tab, the long tab having means for cooperating with a holding device during fabrication while the short tab is welded to the associated skin.

7. The structural panel as claimed in claim 1, further comprising means for connecting a plurality of said panels together.

8. The structural panel as claimed in claim 7, wherein said means for connecting includes an elongated member bonded to proximate edges of adjacent panels.

9. A method of forming a structural panel, comprising the steps of:

(a) providing a first skin, a second skin and a web core including a plurality of primary grid members and cross grid members, all composed of a metal, (b) mounting the cross grid members in a spaced relationship on the primary grid members to present an interlocked grid, including mating slots formed in the primary grid members with slots formed in the cross grid members, and (c) affixing the first and second skins on opposed sides of the grid, including providing spaced-apart pairs of spaced projections that extend from at least certain of said grid members and welding the projections to the skins.

10. The method as claimed in claim 9, wherein said step (c) further includes providing openings in the skins to receive corresponding projections.

11. The method as claimed in claim 10, wherein said step (c) further includes providing each pair of projections with a relatively long projection and a relatively short projection, temporarily securing the skins to the grid using the long projections while welding the shorter projections to the skins.

* * * * *